United States Patent [19]

Almouli

[11] 4,142,650

[45] Mar. 6, 1979

[54] AEROSOL DISPENSER PARTICULARLY USEFUL AS A POCKET FIRE EXTINGUISHER

[76] Inventor: Albert A. Almouli, 24 Lipski St., Tel Aviv, Israel

[21] Appl. No.: 825,396

[22] Filed: Aug. 17, 1977

Related U.S. Application Data

[63] Continuation of Ser. No. 691,983, Jun. 2, 1976, abandoned.

[51] Int. Cl.[2] ..... B67D 5/52

[52] U.S. Cl. ..... 222/135; 222/180; 222/325; 222/402.11

[58] Field of Search ..... 222/135–139, 222/153, 174, 180, 183, 402.11, 402.13, 402.15, 325, 182; 239/304, 305

[56] References Cited

U.S. PATENT DOCUMENTS

| | | | |
|---|---|---|---|
| 2,685,989 | 8/1954 | Samuels | 222/402.15 |
| 3,236,418 | 2/1966 | Dalle et al. | 222/135 |
| 3,236,457 | 2/1966 | Kennedy et al. | 222/135 |
| 3,373,908 | 3/1968 | Crowell | 222/402.13 |
| 3,506,159 | 4/1972 | Muller | 222/135 |
| 3,635,372 | 1/1972 | VanDyck et al. | 222/135 |
| 4,019,658 | 4/1977 | Consaul | 239/305 |

*Primary Examiner*—Stanley H. Tollberg
*Assistant Examiner*—H. Grant Skaggs
*Attorney, Agent, or Firm*—Benjamin J. Barish

[57] ABSTRACT

An aerosol dispenser particularly useful as a pocket fire extinguisher comprises a housing having a plurality (e.g. two) of aerosol containers in side-by-side relationship, each including a depressible valve within the housing and a dispensing nozzle aligned with one of a plurality of housing outlet openings. The housing further includes a single pivotable operator having a manipulatable element externally of the housing and a plurality of actuating elements internally of the housing effective to depress the valve members of all the aerosol containers upon pivoting of the operator. The dispenser further includes a blocking element located to block the movement of the operator, the blocking element being integrally formed with the housing as a portion of its wall underlying the manipulatable element of the operator and joined to the housing by a weakened juncture to permit its forceful removal and thereby to enable the pivoting of the operator at the time the contents of the aerosol containers are to be dispensed.

5 Claims, 9 Drawing Figures

AEROSOL DISPENSER PARTICULARLY USEFUL AS A POCKET FIRE EXTINGUISHER

This is a continuation of application Ser. No. 691,983 filed June 2, 1976 and now abandoned.

BACKGROUND OF THE INVENTION

The present invention relates to aerosol dispensers. The invention is particularly useful for aerosol type pocket fire extinguishers, and is therefore described below with respect to that application although it could also be used in other applications as well.

A number of different types of aerosol type pocket fire extinguishers have been proposed, but their use has been very limited because of the limited quantity of fire extinguishing material they are capable of dispensing: inadequate safety guards to prevent their actuation when they are not intended to be used; and/or their use of costly parts or costly assembly procedures.

SUMMARY OF THE INVENTION

An object of the present invention is to provide an aerosol dispenser having advantages in the above respects, which advantages make it eminently suitable for use as a pocket fire extinguisher. The dispenser could, however, be advantageously used in other applications as well, such as for dispensing paint or other materials.

According to one aspect of the present invention, the dispenser includes a plurality (e.g., two in the described embodiment) of cylindrical aerosol containers disposed within the internal compartment of a housing in side-by-side relationship, the housing including a corresponding plurality of openings each for receiving the nozzle of one of the aerosol containers. The dispenser further includes an operator having a single manipulatable element externally of the housing and a corresponding plurality of actuator elements internally of the housing each engagable with the valve member of one of the aerosol containers.

According to another feature in the described embodiment of the invention, the housing includes a blocking element located to block the movement of the operator manipulatable element, the blocking element being joined to the housing by a weakened juncture to permit its forceful removal, and thereby to enable the movement of the operator manipulatable element at the time the contents of the aerosol container are to be dispensed.

In the preferred embodiment of the invention described below, the dispenser operator, after the blocking element has been removed, is pivotable within the housing upon depression of the manipulatable element. The blocking element is integrally formed with the housing as a portion of its wall underlying the manipulatable element, so that the forceful removal of the blocking element provides a recess in the housing wall permitting the depression of the manipulatable element of the dispenser operator.

BRIEF DESCRIPTION OF THE DRAWINGS

Further features and advantages of the invention will be apparent from the description below of one form of aerosol dispenser constructed in accordance with the invention and illustrated in the accompanying drawings, wherein.

DESCRIPTION OF THE PREFERRED EMBODIMENT

Figures 1, 2, 3, 4, 5, 6, 7, 8, 9:
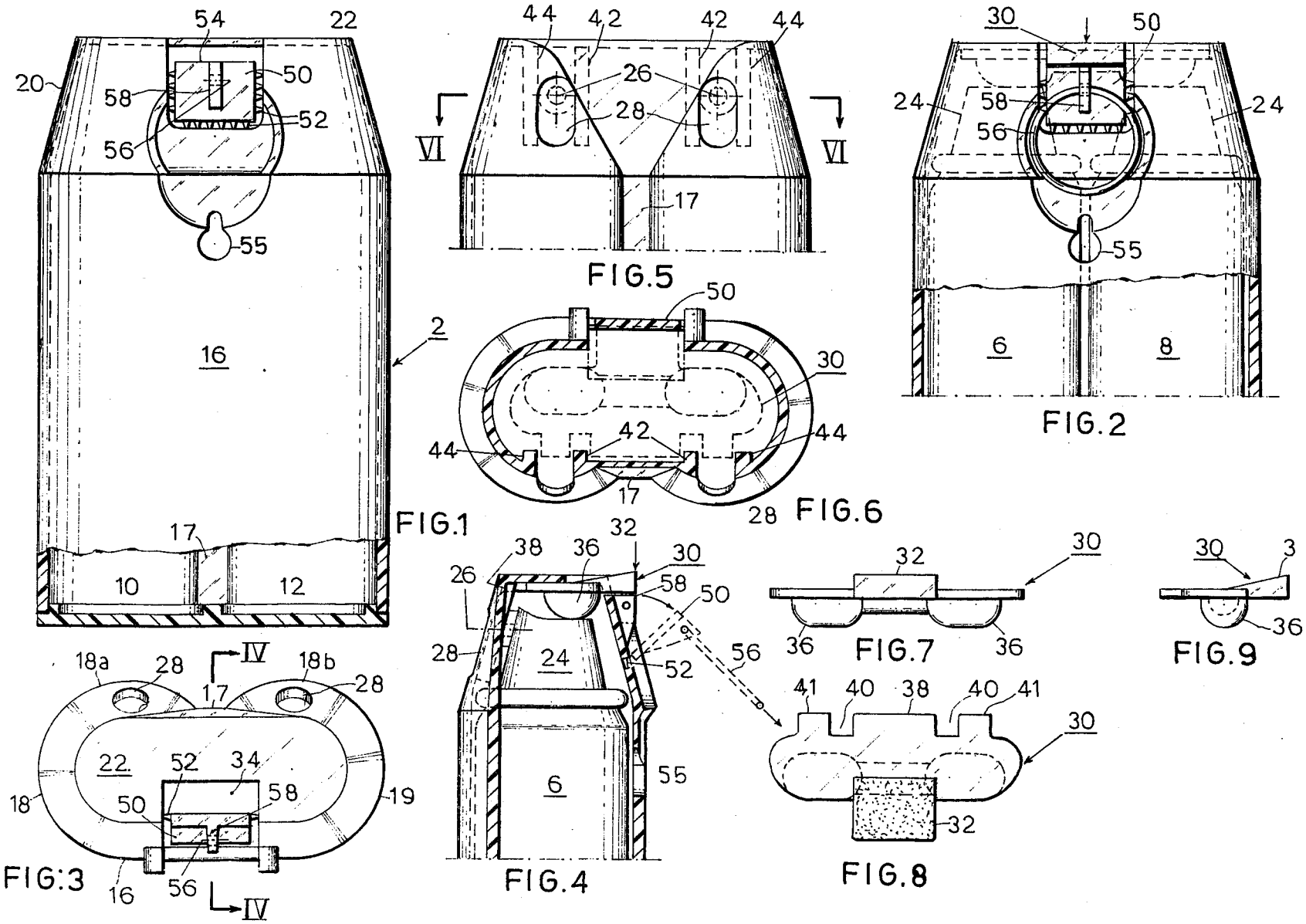
FIG. 1 is a side elevational view, partly in section, of the housing for use in the described aerosol dispenser constructed in accordance with the invention.
FIG. 2 is a corresponding view as FIG. 1 of only the upper half of the aerosol dispenser and including the housing of FIG. 1 and the aerosol containers therein.
FIG. 3 is a top plan view of the housing of FIG. 1.
FIG. 4 is a sectional view along lines IV—IV of FIG. 3.
FIG. 5 is a side elevational view of the upper part of the housing of FIG. 1 from the opposite side.
FIG. 6 is a sectional view along lines VI—VI of FIG. 5.
FIGS. 7, 8, and 9 are side, top, and end views, respectively, of the dispenser operator included in the aerosol dispenser.

The aerosol dispenser illustrated in the drawings comprises a housing, generally designated 2 (FIG. 1), formed with an internal compartment 4 substantially rectangular in cross-section for receiving two cylindrical aerosol containers 6, 8 (FIG. 2), the bottom of each container being received within a circular recess 10, 12, formed in the bottom wall 14 of the housing. Housing 2 further includes a pair of side walls 16, 17, joined together by curved end walls 18, 19. Wall 16 is substantially flat, but wall 18 is formed with a pair of substantially cylindrical bulges with the curve end walls 18, 19, for accommodating the cylindrical aerosol containers 6, 8. All the walls 16–19 taper inwardly at their upper ends, as shown at 20, the upper end being closed by a flat top wall 22.

The aerosol containers, 6, 8, may be of the conventional type, each including a depressible valve operator 24 having a nozzle 26 (FIGS. 4 and 5) through which the contents of the container are expelled when the valve operator 24 is depressed. The upper portion 20 of side wall 18 is provided with a pair of outlet openings 28 each aligned with a nozzle 26 of one of the aerosol containers, both openings and nozzles being oriented in the same direction. Openings 28 receive the nozzles 26 and are vertically elongated to permit their downward movement upon the depression of the respective valve members 24.

A dispenser operator, generally designated 30 and particularly illustrated in FIGS. 7–9, is disposed in the upper end of housing 2 between the valve members 24 of the aerosol containers and the top wall 22 of the housing. Operator 30 is a unitary plastics member and has a single manipulatable element 32 formed on its front edge and projecting through an opening 34 formed in the top wall 22 and the side wall 16 of the housing. Operator 30 further includes a pair of actuating elements 36 in the form of cylindrical projections depending from the lower surface of the operator and engaging the upper surfaces of the depressible valve members 24 of the aerosol containers 6, 8. The rear edge 38 of operator 30 is formed with a pair of end slots 40 defining lugs 41 which are received within a pair of vertically-extending ribs 42, 44 (FIG. 5) formed in the inner surface of housing 2 on opposite sides of each of the elongated openings 28.

The contents of the two aerosol containers 6, 8 may be dispensed by depressing manipulatable element 32 of operator 30, in which case the operator pivots along its rear edge 38, engaging top wall 22 of housing 2, while ribs 42 and 44 received within slots 40 of operator 30, guide the downward movement of the nozzles 26, and also guide the pivotal movement of the operator. During this pivotal movement of the operator, projections 36, depending from its lower surface, bear against the valve members 24 of the aerosol containers 6, 8, thereby causing the dispensing of the contents of these containers via their respective nozzles 26, the latter moving within the elongated openings 28 of the housing.

To prevent the accidental dispensing of the material within the aerosol containers 6, 8, housing 2 is provided with a blocking element which underlies the manipulatable element 32 of dispenser operator 30. The pivotal movement of the operator is thus prevented until the blocking element is removed. This blocking element is constituted of a substantially rectangular section 50 integrally formed with wall 16 of housing 2 directly under manipulatable element 32 of the operator 30. This wall section 50 is connected to the wall by a weakened juncture 52 in the form of a series of perforations formed along its three sides joined to the wall. The upper edge 54 is unattached to the housing and is aligned with manipulatable element 32 of operator 30. Wall 16 of the housing is further formed with a bayonnette opening 55 to facilitate mounting the dispenser.

It will be seen that so long as the blocking wall section 50 is in place, its upper edge 54 prevents the depression of manipulatable element 32 of operator 30, and therefore prevents the depression of the projections 36 on operator 30 to actuate the valve members 24 of the aerosol containers 6, 8. When it is desired to use the fire extinguisher, wall section 50 is forcefully removed, this being facilitated by a ring 56 received within an opening in a projecting lug 58. Manipulatable element 32 may then be depressed, causing its depending projections 36 to depress valve members 24, whereupon the aerosol containers 6, 8 dispense their contents through their respective nozzles 26 within the housing outlet openings 28.

It will thus be seen that the fire extinguisher is safeguarded against actual operation until it is intended to be used, at which time wall section 50 is torn away along its weakened lines 52 from the housing 2, and manipulatable element 32 of the operator 30 is depressed. Ring 56 and projection 58 could be omitted from the removable wall section 50, in which case the latter would be removed by pressing inwardly, rather than outwardly, to detach it from the remainder of the housing wall.

The provision of two (or more) aerosol containers within the housing in side-by-side relationship provides further important advantages, namely compactness, relative flatness for reception within a pocket, the capability of dispensing a large quantity of material, and a wide coverage of the dispensed material since it issues from two spaced nozzles.

The parts of the dispenser may be constructed in mass production at low cost. The dispenser may also be assembled at low cost, by first inserting valve operator 30 through the open bottom end of housing 2 while the latter is in its inverted position; inserting the inverted aerosol containers 6, 8; and then bonding the bottom wall 14 to the side walls 16, 18 of the housing.

While the invention has been described with respect to a preferred embodiment for use as a pocket fire extinguisher, it will be appreciated that many variations, modifications and other applications (e.g., for dispensing paint or other materials) of the invention may be made.

What is claimed is:

1. An aerosol dispenser, comprising: a housing including side, bottom and top walls defining an internal compartment and having a plurality of outlet openings in a side wall oriented in the same direction laterally of the housing; a plurality of aerosol containers disposed within the internal compartment of the housing in side-by-side relationship; each aerosol container including a depressible valve member within the housing and a dispensing nozzle aligned with one of said housing outlet openings through which the contents of the container are dispensed upon depression of the respective valve member; and a movable dispenser operator pivotable at the top of the housing and including a single depressible element externally of the housing and a plurality of actuating elements internally of the housing each engagable with the valve member of one of the aerosol containers, all said internal actuating elements being actuated by said single external manipulatable element to depress all the valve members simultaneously upon depression of the depressible element; said housing further including a blocking element located to block the depression of the single depressible element, said blocking element being integrally formed with the housing and being jointed by a weakened juncture to a portion of its wall underlying said depressible element so that the forceful removal of the blocking element provides a recess in the housing wall permitting the depression of the depressible element of the dispenser operator.

2. A dispenser according to claim 1, wherein said operator is a unitary plastics member in which its depressible element is formed on its front edge and projects through a further opening in the housing, its actuating elements are each in the form of a projection depending from its lower surface, and its rear edge is engageable with the top wall of the housing to enable pivoting the operator after the blocking element has been removed.

3. A dispenser according to claim 1, wherein the nozzle of each aerosol container is depressible with the valve member, each of said outlet openings in the side wall of the housing receiving the nozzle of one of the aerosol containers being vertically elongated to permit the depression of the nozzles with their respective valve members, the housing wall being further formed with a pair of ribs on each side of each of said outlet openings for guiding the movement of the nozzle of its respective aerosol container, the rear edge of the dispenser operator being formed with a pair of slots receiving said ribs for guiding the movement of the operator.

4. A dispenser according to claim 1, wherein the blocking element includes a ring attached at a mid-portion thereof to the blocking element and graspable by the user to facilitate the forceful removal of the blocking element from the housing.

5. A dispenser according to claim 1, wherein said internal compartment of the housing is substantially rectangular in section.

* * * * *